US006674039B1

(12) United States Patent
Banghard et al.

(10) Patent No.: US 6,674,039 B1
(45) Date of Patent: Jan. 6, 2004

(54) CONTACT ARRANGEMENT FOR A VACUUM INTERRUPTER

(75) Inventors: Johannes-Gerh Banghard, Friedrichsthal (DE); Klemens Fieberg, Berlin (DE); Michael Hahn, Berlin (DE); Werner Hartmann, Grossenseebach (DE); Roman Renz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/031,907

(22) PCT Filed: Jul. 20, 2000

(86) PCT No.: PCT/DE00/02443

§ 371 (c)(1),
(2), (4) Date: Jan. 18, 2002

(87) PCT Pub. No.: WO01/08186

PCT Pub. Date: Feb. 1, 2001

(30) Foreign Application Priority Data

Jul. 21, 1999 (DE) ..... 199 34 909

(51) Int. Cl.[7] ..... H01H 33/66
(52) U.S. Cl. ..... 218/123; 218/127
(58) Field of Search ..... 218/123–128, 218/155, 118–120

(56) References Cited

U.S. PATENT DOCUMENTS

| | | | | |
|---|---|---|---|---|
| 3,158,719 A | | 11/1964 | Polinko et al. | |
| 3,576,960 A | * | 5/1971 | Kurtz | 218/123 |
| 3,809,836 A | | 5/1974 | Crouch | |
| 3,869,589 A | | 3/1975 | Hundstand | |
| 4,667,070 A | * | 5/1987 | Zueckler | 218/123 |
| 5,210,385 A | | 5/1993 | Morel et al. | |
| 5,661,281 A | | 8/1997 | Fieberg et al. | |

FOREIGN PATENT DOCUMENTS

| | | |
|---|---|---|
| DE | 2 321 753 | 11/1973 |
| DE | 29 12 823 | 10/1980 |
| DE | 34 34 417 A1 | 3/1986 |
| DE | 41 30 230 A1 | 3/1993 |
| GB | 1145151 | 3/1969 |
| GB | 2 071 421 A | 9/1981 |

* cited by examiner

*Primary Examiner*—Lincoln Donovan
(74) *Attorney, Agent, or Firm*—Harness, Dickey & Pierce, P.L.C.

(57) ABSTRACT

In a vacuum interrupter for circuit breakers, the aim is to reduce the contact pressure force. The contacts of the vacuum interrupter are configured for this purpose such that there is arranged inside an outer contact region, serving the purpose of arc quenching, an inner contact region which includes a plurality of resilient contact tongues arranged next to one another on a divided circle.

20 Claims, 3 Drawing Sheets

CONTACT ARRANGEMENT FOR A VACUUM INTERRUPTER

This application is the national phase under 35 U.S.C. §371 of PCT International Application No. PCT/DE00/02443 which has an International filing date of Jul. 20, 2000, which designated the United States of America, the entire contents of which are hereby incorporated by reference.

FIELD OF THE INVENTION

The invention generally relates to the field of electric components, and is preferably to be applied in designing the configuration of vacuum interrupters. More preferably, it relates to vacuum interrupters in which at least one of the two contacts has an inner contact region which projects axially over an outer contact region serving the purpose of arc quenching.

BACKGROUND OF THE INVENTION

Vacuum interrupters with contact arrangements of the type are known. In this case, the two contacts, of which, generally speaking, only one can be moved axially relative to the other, are fitted with circular or slightly conical contact surfaces which face one another. Contacts which are constructed as what are termed "vane/blade electrodes" or "spiral contacts" have an inner contact region provided for switching operating currents, and an outer contact region, which surrounds the inner contact region concentrically, is provided for interrupting short-circuit currents and serves as running surface for a rotating arc. In this case, the inner contact region projects over the outer contact region by a certain, not very large amount (U.S. Pat. Nos. 3,158,719 A, 3,809,836 A).

Vacuum interrupters are also known in which the contact region provided for switching operating currents is identical with the contact region provided for interrupting the short-circuit currents. These contacts are of cup-shaped construction, the wall of the cup and, if appropriate, also the contact ring mounted on the top edge being provided with a plurality of slits which run obliquely relative to the longitudinal axis of the contact arrangement. The contact surface can be subdivided into a plurality of contact subsurfaces by means of these slits (DE 23 21 753 A1, DE 29 12 823 A1).

In order to be able to separate welded contact regions more easily from one another in the case of vacuum interrupters, it is known to give each contact a relatively large number of contact surfaces and to hold these elastically on a main contact body. A tubular main contact body can be provided for this purpose with radially inwardly projecting support arms for the contact surfaces (U.S. Pat. No. 3,869,589 A).

Furthermore, for air-switching circuit breakers in the low-voltage field it is known per se to split up the movable contact into a plurality of contact fingers arranged parallel to one another, for the purpose of reducing the contact pressure force (U.S. Pat. No. 5,210,385 A).

In vacuum interrupters for circuit breakers, in particular for circuit breakers in the low-voltage field (for example U.S. Pat. No. 5,661,281), the high currents give rise to high forces on the contacts which tend to raise the contacts off one another. These current forces must be compensated by means of suitable measures so that the contacts do not lift off with the risk of them becoming welded to one another. In the case of switches fitted with vacuum interrupters, this problem has been solved so far by making use, in addition to a permanently applied static contact pressure force, of an additional current loop with the aid of which high dynamic magnetic field forces which act to strengthen the contact force are produced in the short term, that is to say particularly during the occurrence of short circuit currents. There is no need thereby for mechanical application of the entire contact pressure force, which is required only in the short term. Because of the relatively high costs of such current loops, the contact force to be mechanically applied in a permanent fashion continues, however, to be relatively large and can be several kN per switching pole, particularly in the case of high currents of more than 50 kA. This requires a correspondingly high mechanical outlay in the switching device.

SUMMARY OF THE INVENTION

Starting from a contact arrangement having the features of the preamble of patent claim 1, it is an object of the invention to construct the contact arrangement such that the mechanical contact point is distributed over a plurality of separate individual contacts with a defined spring constant, and that an arc can nevertheless rotate.

In order to achieve this object, for example, it is provided according to the invention that the inner contact region including a plurality of contact subregions arranged next to one another on a divided circle, each contact subregion being formed by the free end of a resilient contact tongue inclined relative to the axis of the contact arrangement.

Such a configuration of the contact arrangement permits the contact region provided for switching operating currents to be broken down into a larger number of, for example, three to ten subregions and for these subregions to be constructed as resilient contact tongues opposite which there is a mating contact piece in each case, and to decouple the contact tongues so far from one another mechanically by appropriate dimensioning of the spring constant that in the closed state of the contact arrangement all the subregions are subjected to a contact pressure force of the same magnitude. The resilient contact tongues can be arranged in this case such that upon opening and closing of the contact system a frictional movement is avoided, and thus so is abrasion in the form of metallic chips.

In order to have sufficient space to configure the dimensioning of the spring constants of the contact tongues, the contact tongues can be produced from a flat, conical shell by multiply slitting the shell wall in an axial fashion. In this case, the spring constant can be varied, in particular, by the thickness of the shell wall and the number of the slits and/or the width of the contact tongues. Similar relationships are obtained when the contact tongues are produced from a flat, hollow conical frustum by multiply slitting the conical lateral surface in an axial fashion.

In a way resembling the configuration of the slit contact carrier of what are termed cup-shaped contacts, the contact tongues can also be produced from a tube length by providing the wall thereof with a plurality of obliquely running slits.

The design configuration described for the contact tongues can be applied both in the case of spiral contacts and in the case of cup-shaped contacts. The body used for the contact tongues can include, in this case of dispersion-hardened copper, a specific copper alloy or a copper/chromium material with a small proportion of chromium. It is fabricated separately and arranged in the middle of the respective contact in an appropriate cutout and soldered to the remaining contact body.

BRIEF DESCRIPTION OF THE DRAWINGS

A plurality of exemplary embodiments of contact arrangements constructed in accordance with the invention are illustrated in FIGS. 1 to 7. In the drawings.

DETAILED DESCRIPTION OF THE PREFERRED EMBODIMENTS

Figure 1:
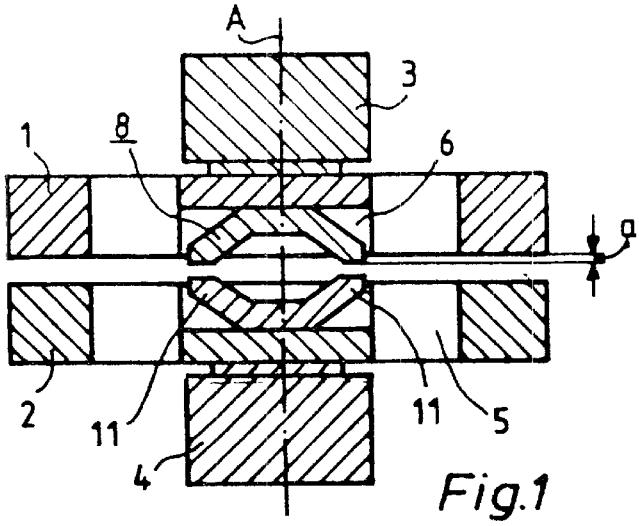
FIG. 1 shows a first exemplary embodiment of a contact arrangement in which the inner contact region is formed by a shell-shaped contact body.

The contact arrangement in accordance with FIG. 1 includes an upper contact 1 and a lower contact 2, which are arranged axially relative to one another along an axis A with mutually facing contact surfaces. In this arrangement, one contact can be moved axially—in a way not shown in more detail, but known. Each of the two contacts 1 and 2 is provided with a current supply lead 3 and 4, respectively.

Figure 2:
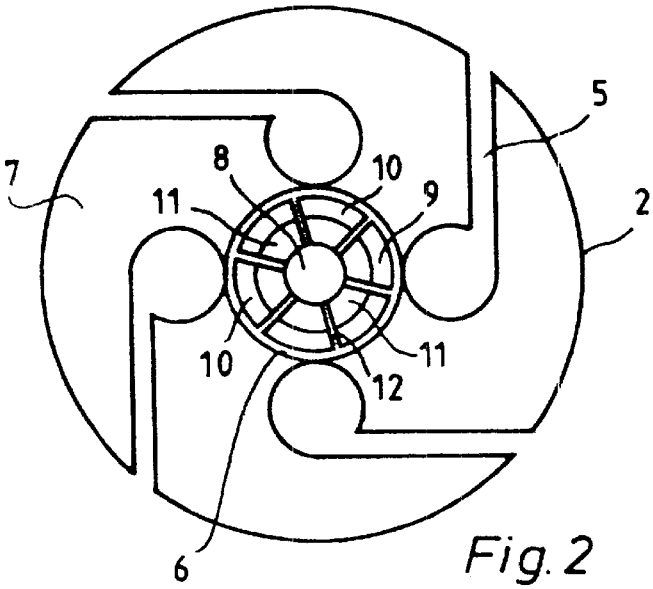
FIG. 2 shows a top view of a contact arrangement in accordance with FIG. 1.

In accordance with FIG. 2, each contact is constructed as what is termed a "spiral contact" in accordance with European patent 0 332 513 B1, each slit 5 including two sections, of which the first section runs parallel to a tangent, applied to the circumference of a circular cutout 6, and of which the second section includes a bore which, in the region of the inner end of the first section, penetrates the contact surface between the first section and the circular cutout 6. The region of the contact which is situated outside the cutout 6 forms an outer contact region 7 which is provided for interrupting short-circuit currents and serves as running surface for a rotating arc.

The cutout 6 is designed so deeply that it can accommodate an additional contact body 8, which forms an inner contact region 9. This inner contact region 9, which is provided for switching operating currents, projects axially over the outer contact region 7, arranged concentrically with the inner contact region, by a certain length a, which is 2 mm, for example.

In accordance with FIGS. 1 and 2, the contact body 8 has the shape of a flat, conical shell whose shell wall is multiply slit in the axial direction. A plurality of contact subregions 10 are formed by this slit arrangement 12. The bottom of the shell-shaped contact body 8, which is soldered to the contact piece 1 or 2, is not slit, and so the slit arrangement forms a plurality of resilient contact tongues 11 which are inclined relative to the axis A of the contact arrangement and whose free end forms a contact subregion 10 in each case.

Figure 3:
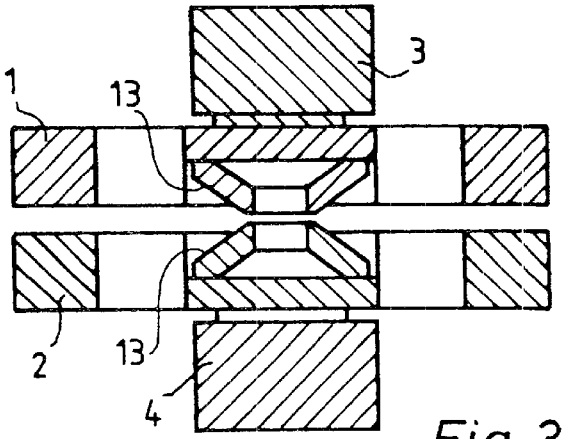
FIG. 3 shows a second exemplary embodiment of a contact arrangement, with an inner contact region constructed as a hollow conical frustum.

In the case of a contact arrangement in accordance with FIG. 3, the contact body 13 forming the inner contact region is constructed as a flat, hollow conical frustum whose lateral surface is multiply slit in an axial fashion. This slit arrangement does not go as far as the base of the conical frustum, so as to be able to solder the contact body as a whole to the respective contact piece.

Figure 4:
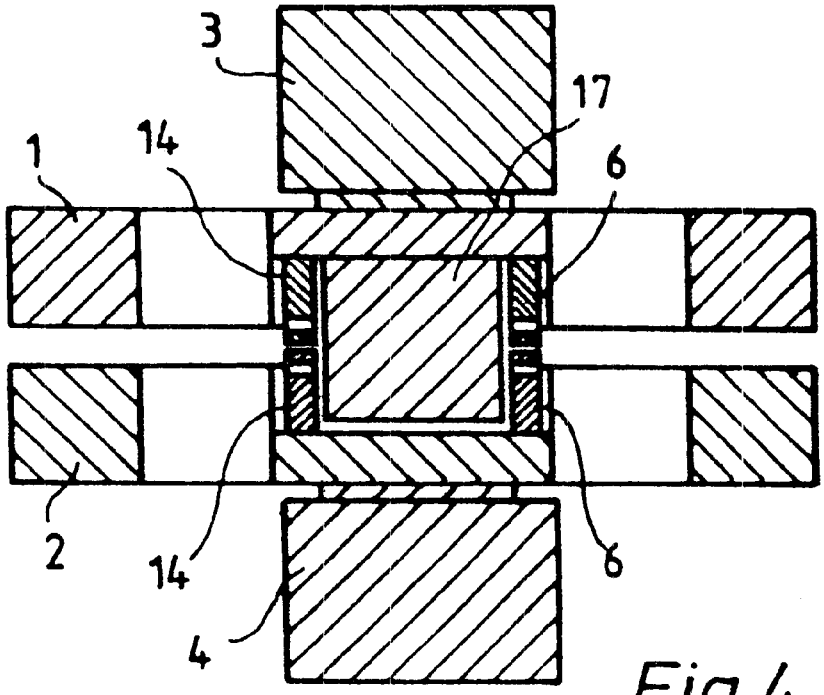
FIG. 4 shows a third exemplary embodiment, with an inner contact region constructed as a slit tube length.
Figure 5:
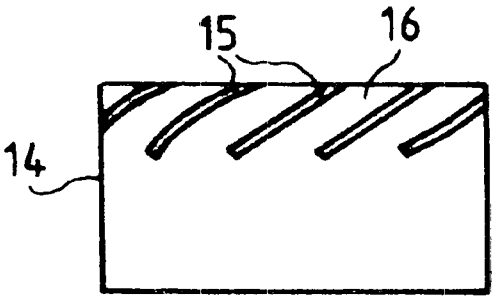
FIG. 5 shows a schematic illustration of the inner contact region in accordance with FIG. 4, in a side view.

In the exemplary embodiment in accordance with FIG. 4, use is made in the cutout 6 of the contacts 1 and 2 as contact body for the inner contact region of a hollow cylinder in the form of a tube length 14 which is provided, in accordance with FIG. 5, with slits 15 running obliquely to the axis of the contact arrangement, as a result of which resilient contact tongues 16 are formed. Additionally arranged on the upper contact 1 inside the tube length 14 is a contact piece 17 which forms a mechanical support in the closed state of the contacts 1 and 2. In the case of operating currents, this contact piece also conducts the current, it being possible to achieve the lowest contact resistances as a result. In the case of short-circuit currents, as the additional contact piece 17 starts to lift off, that is to say when there is a slight rise in the contact resistance, the resilient contact regions of the contact body resembling a tube length take over the conducting of current and thus prevent complete lifting off and welding of the contact system.

Figure 6:
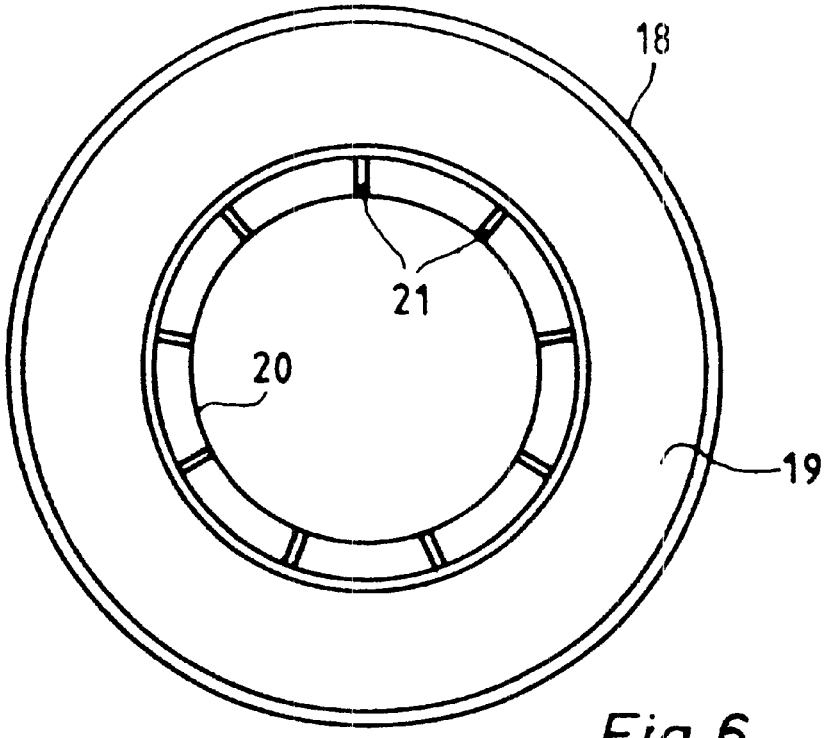
FIGS. 6 and 7 show a fourth exemplary embodiment, with an inner contact region likewise constructed as a slit tube length.
Figure 7:
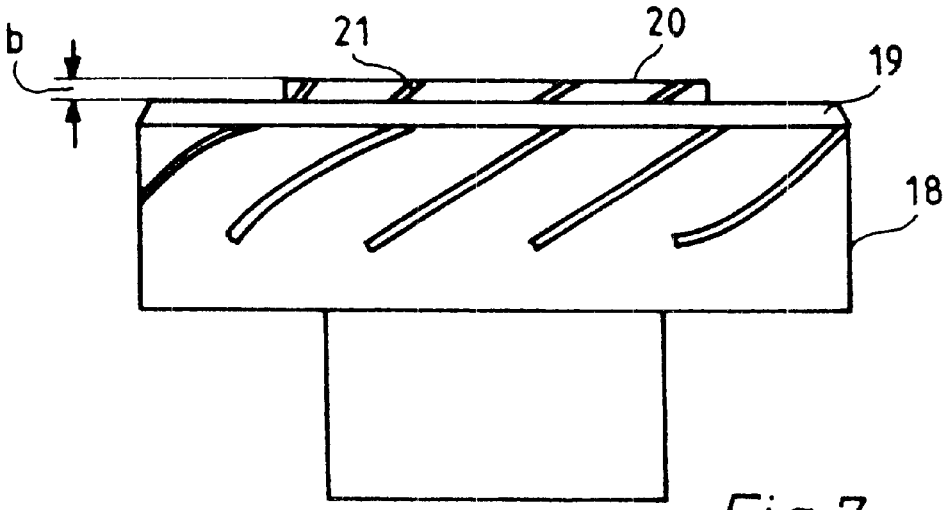

The exemplary embodiment in accordance with FIGS. 6 and 7 shows a cup-shaped contact 18 whose slit wall is covered at the cup edge with an annular contact disk 19, this contact disk forming the outer contact region of the contact. Arranged inside the cup-shaped contact is a contact body 20 which is of similar construction to the contact body 14 in accordance with FIGS. 4 and 5, and includes a tube length whose wall is provided with a plurality of obliquely running slits 21. The contact body 20, which forms the inner contact region of the cup-shaped contact 18, projects through the contact disk 19 axially by the length b, which is 2 mm, for example.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A contact arrangement for a vacuum interrupter, comprising:

at least two contacts, axially movable relative to one another and including mutually facing contact surfaces, wherein each contact includes an inner contact region, provided for switching operating currents, and an outer contact region, which surrounds the inner contact region concentrically and which is provided for interrupting short-circuit currents and which serves as running surface for a rotating arc, and wherein the inner contact region projects axially over the outer contact region and includes a plurality of contact subregions arranged next to one another on a divided circle, each contact subregion being formed by a free end of a resilient contact tongue inclined relative to an axis of the contact arrangement.

2. The contact arrangement as claimed in claim 1, wherein the inner contact region includes a flat, conical shell whose shell wall is multiply slit in an axial fashion.

3. The contact arrangement as claimed in claim 1, wherein the inner contact region includes a flat, hollow conical frustum whose lateral surface is multiply slit in an axial fashion.

4. The contact arrangement as claimed in claim 1, wherein the inner contact region includes a tube length whose wall is provided with a plurality of obliquely running slits.

5. The contact arrangement as claimed in claim 1, wherein the outer contact region includes the arms of a spiral contact.

6. The contact arrangement as claimed in claim 1, wherein the outer contact region includes the contact surface of a cup-shaped contact.

7. The contact arrangement as claimed in claim 2, wherein the outer contact region includes the arms of a spiral contact.

8. The contact arrangement as claimed in claim 3, wherein the outer contact region includes the arms of a spiral contact.

9. The contact arrangement as claimed in claim 4, wherein the outer contact region includes the arms of a spiral contact.

10. The contact arrangement as claimed in claim 2, wherein the outer contact region includes the contact surface of a cup-shaped contact.

11. The contact arrangement as claimed in claim 3, wherein the outer contact region includes the contact surface of a cup-shaped contact.

12. The contact arrangement as claimed in claim 4, wherein the outer contact region includes the contact surface of a cup-shaped contact.

13. A vacuum interrupter including the contact arrangement of claim 1.

14. A vacuum interrupter including the contact arrangement of claim 2.

15. A vacuum interrupter including the contact arrangement of claim 3.

16. A vacuum interrupter including the contact arrangement of claim 4.

17. A circuit breaker including the vacuum interrupter of claim 13.

18. A circuit breaker including the vacuum interrupter of claim 14.

19. A circuit breaker including the vacuum interrupter of claim 15.

20. A circuit breaker including the vacuum interrupter of claim 16.

* * * * *